US011526119B2

(12) United States Patent
Hatano et al.

(10) Patent No.: US 11,526,119 B2
(45) Date of Patent: Dec. 13, 2022

(54) DEVELOPING CARTRIDGE INCLUDING FIRST SEPARATION MEMBER AT FIRST OUTER SURFACE OF CASING, AND SECOND SEPARATION MEMBER AT SECOND OUTER SURFACE OF CASING

(71) Applicant: BROTHER KOGYO KABUSHIKI KAISHA, Nagoya (JP)

(72) Inventors: Shuhei Hatano, Nagoya (JP); Wataru Yamaguchi, Nisshin (JP); Yasuhiro Hosokawa, Niwa (JP); Nao Itabashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/531,400

(22) Filed: Nov. 19, 2021

(65) Prior Publication Data

US 2022/0171323 A1 Jun. 2, 2022

(30) Foreign Application Priority Data

Nov. 30, 2020 (JP) ..... JP2020-198877

(51) Int. Cl.
*G03G 21/16* (2006.01)
*G03G 21/18* (2006.01)
*G03G 15/08* (2006.01)

(52) U.S. Cl.
CPC ..... *G03G 21/1647* (2013.01); *G03G 15/087* (2013.01); *G03G 21/1821* (2013.01); *G03G 21/1864* (2013.01)

(58) Field of Classification Search
CPC ..... G03G 21/1647; G03G 15/087; G03G 21/1821; G03G 21/1864; G03G 21/1676
See application file for complete search history.

(56) References Cited

U.S. PATENT DOCUMENTS

2008/0286001 A1* 11/2008 Matsumoto ..... G03G 21/1828 399/112
2009/0169257 A1 7/2009 Sato et al.
2013/0051849 A1 2/2013 Itabashi et al.
2019/0302674 A1* 10/2019 Wang ..... G03G 21/1676

FOREIGN PATENT DOCUMENTS

JP 2009-162905 A 7/2009
JP 2013-54058 A 3/2013

* cited by examiner

*Primary Examiner* — Sandra Brase
(74) *Attorney, Agent, or Firm* — Merchant & Gould P.C.

(57) ABSTRACT

A developing cartridge includes: a developing roller rotatable about an axis extending in a first direction; a casing having a first outer surface and a second outer surface spaced apart from each other in the first direction; a first separation member positioned at the first outer surface; and a second separation member positioned at the second outer surface. The second separation member has a first end portion configured to contact a body-side cam of an image-forming apparatus. In a state where a drum cartridge is attached to an apparatus body of the image-forming apparatus in an attached state of the developing cartridge to the drum cartridge, the first separation member is pressed by a drum cam of the drum cartridge, and the first end portion of the second separation member is pressed by the body-side cam to move the developing roller from a contacting position to a separated position.

14 Claims, 10 Drawing Sheets

DEVELOPING CARTRIDGE INCLUDING FIRST SEPARATION MEMBER AT FIRST OUTER SURFACE OF CASING, AND SECOND SEPARATION MEMBER AT SECOND OUTER SURFACE OF CASING

CROSS REFERENCE TO RELATED APPLICATION

This application claims priority from Japanese Patent Application No. 2020-198877 filed Nov. 30, 2020. The entire content of the priority application is incorporated herein by reference.

BACKGROUND

There has been known an electro-photographic type image-forming apparatus such as a laser printer and an LED printer. A developing cartridge is used in the image-forming apparatus. The developing cartridge includes a developing roller for supplying developing agent The developing cartridge is attachable to a drum cartridge including a photosensitive drum. The developing roller and the photosensitive drum are made in contact with each other upon attachment of the developing cartridge to the drum cartridge. The drum cartridge to which the developing cartridge is attached is attached to the image-forming apparatus.

SUMMARY

The conventional image-forming apparatus is configured to perform a separating operation for separating the developing roller from the photosensitive drum, after the drum cartridge to which the developing cartridge is attached is attached to the image-forming apparatus. In performing the separating operation, each end portion of the developing roller is applied with a pressing force to move the developing roller away from the photosensitive drum.

Here, in a case where a structure for receiving the pressing force at one end portion of the developing roller is identical to a structure for receiving the pressing force at the other end portion of the developing roller, a space at each end portion of the developing cartridge may not be efficiently utilized.

In view of the foregoing, it is an object of the disclosure to provide a developing cartridge employing different structures between at one end portion and at another end portion of the developing roller for receiving pressing force to perform a separating operation to realize efficient use of the space at each end portion of the developing cartridge.

In order to attain the above and other objects, according to one aspect, the disclosure provides a developing cartridge configured to be attached to an apparatus body of an image-forming apparatus including a body-side cam in an attached state of the developing cartridge to a drum cartridge including a photosensitive drum and a drum cam. The developing cartridge includes a developing roller, a casing, a first separation member, and a second separation member. The developing roller is rotatable about a rotation axis extending in a first direction. The casing is configured to accommodate therein developing agent. The casing has a first outer surface and a second outer surface spaced apart from the first outer surface in the first direction. The developing roller is movable between a contacting position where the developing roller is in contact with the photosensitive drum and a separated position where the developing roller is separated from the photosensitive drum. The first separation member is positioned at the first outer surface and is configured to make contact with the drum cam in a state where the drum cartridge is attached to the apparatus body in the attached state of the developing cartridge to the drum cartridge. The second separation member is positioned at the second outer surface and has a first end portion configured to make contact with the body-side cam in the state where the drum cartridge is attached to the apparatus body in the attached state of the developing cartridge to the drum cartridge. The first separation member is configured to be pressed by the drum cam, and the first end portion of the second separation member is configured to be pressed by the body-side cam to move the developing roller from the contacting position to the separated position in the state where the drum cartridge is attached to the apparatus body in the attached state of the developing cartridge to the drum cartridge.

With this structure, the first separation member is configured to be pressed by the drum cam at the first outer surface of the casing, and the second separation member is configured to be pressed by the body-side cam at the second outer surface of the casing, to move the developing roller from the contacting position to the separated position. In this way, the structure for receiving the pressing force at the first outer surface and the structure for receiving the pressing force at the second outer surface are made different from each other, thereby realizing efficient use of the space at each end portion of the casing in the first direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a developing cartridge 1 according to an embodiment of the present disclosure will be described with reference to the accompanying drawings.

In the following description, an extending direction of a developing roller 30 (FIG. 4) of the developing cartridge 1 will be referred to as a "first direction". Further, a direction of an array of the developing roller 30 and an agitator 20 (FIG. 4) of the developing cartridge 1 will be referred to as a "second direction". The first direction and the second direction cross each other, and preferably be perpendicular to each other.

1. Outlines of Developing Cartridge and Drum Cartridge

Figure 1:
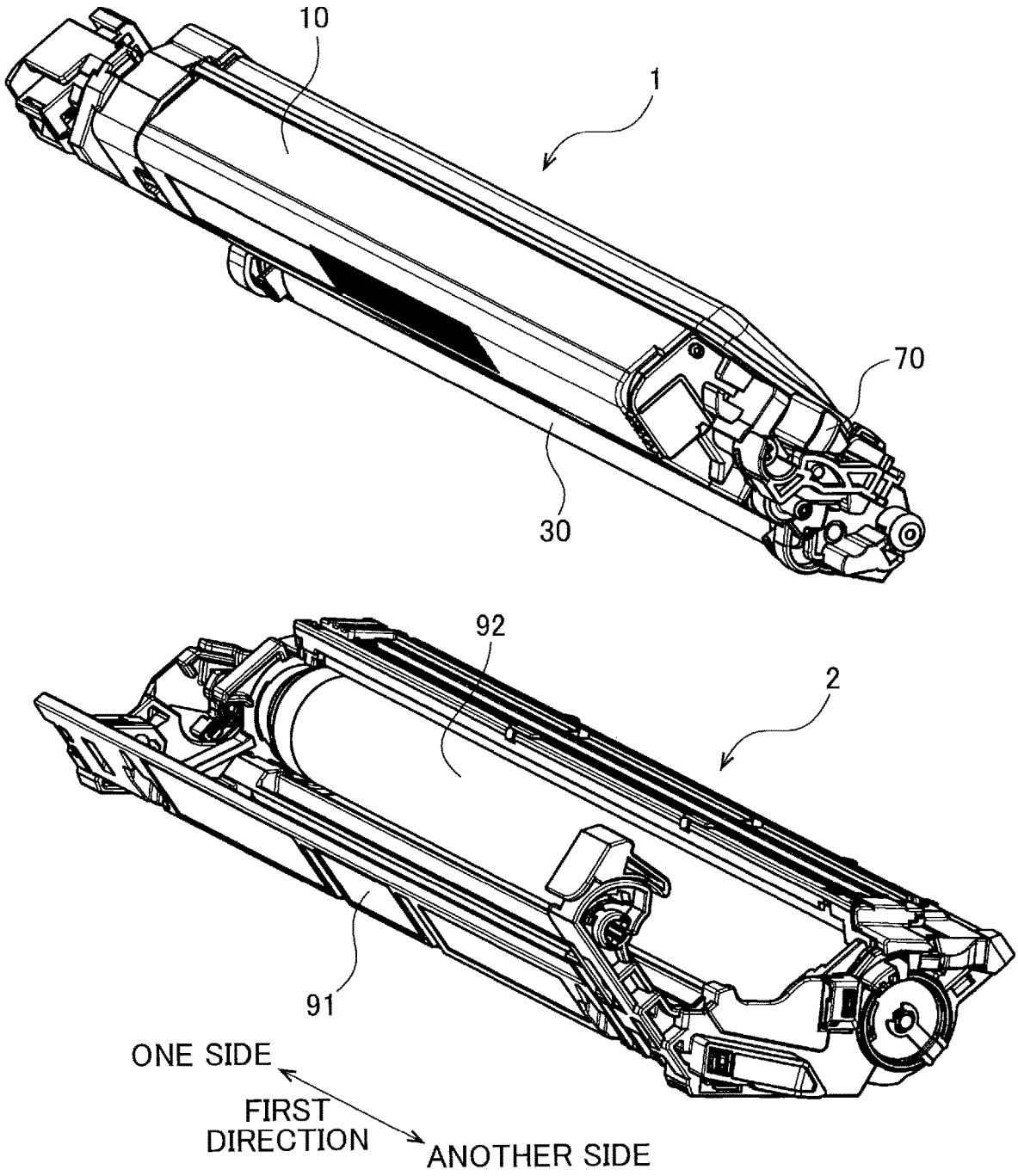
FIG. 1 is a perspective view of a developing cartridge according to an embodiment of the disclosure and a drum cartridge.
Figure 2:
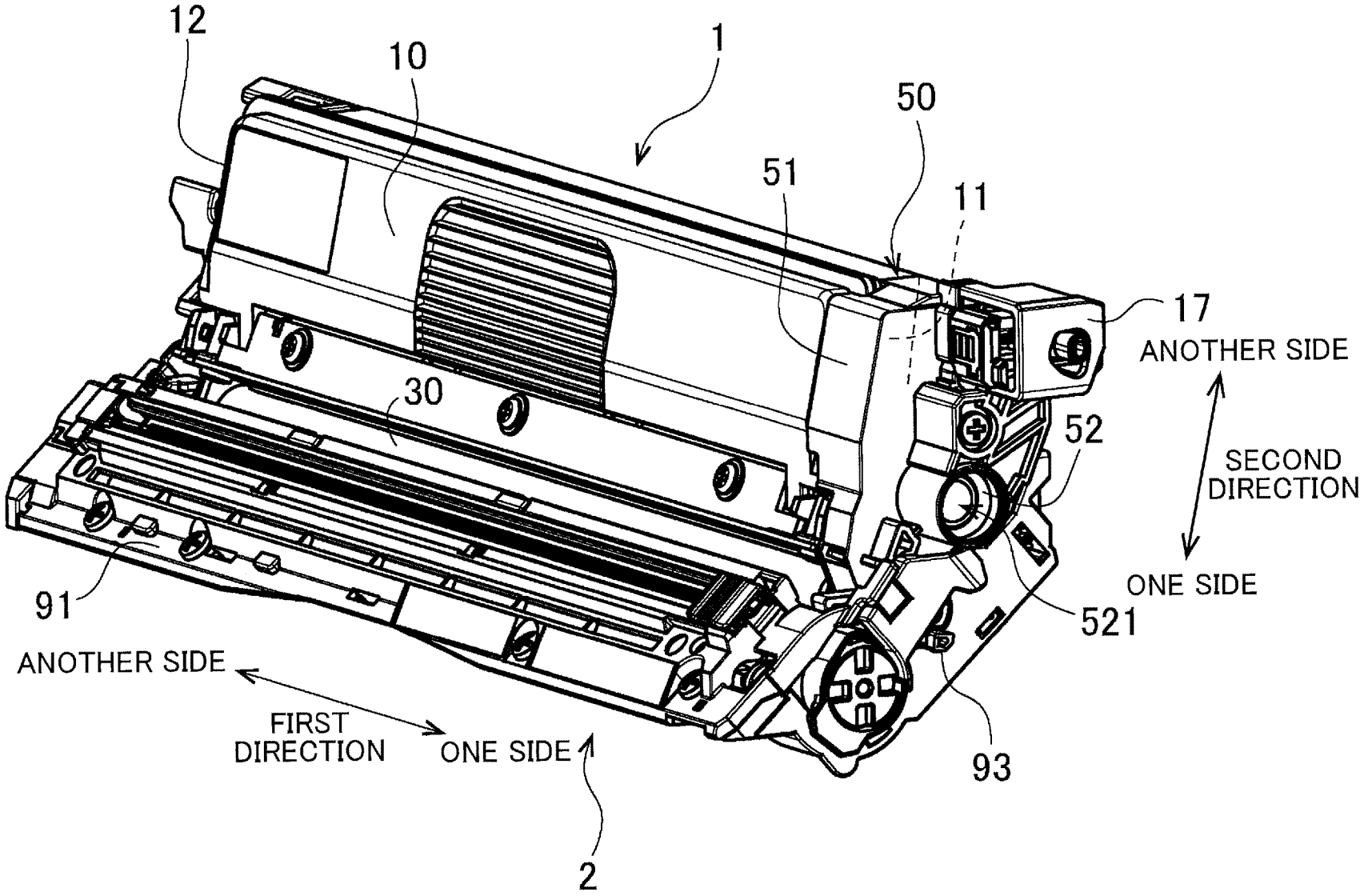
FIG. 2 is a perspective view illustrating a state where the developing cartridge is attached to the drum cartridge.
Figure 3:
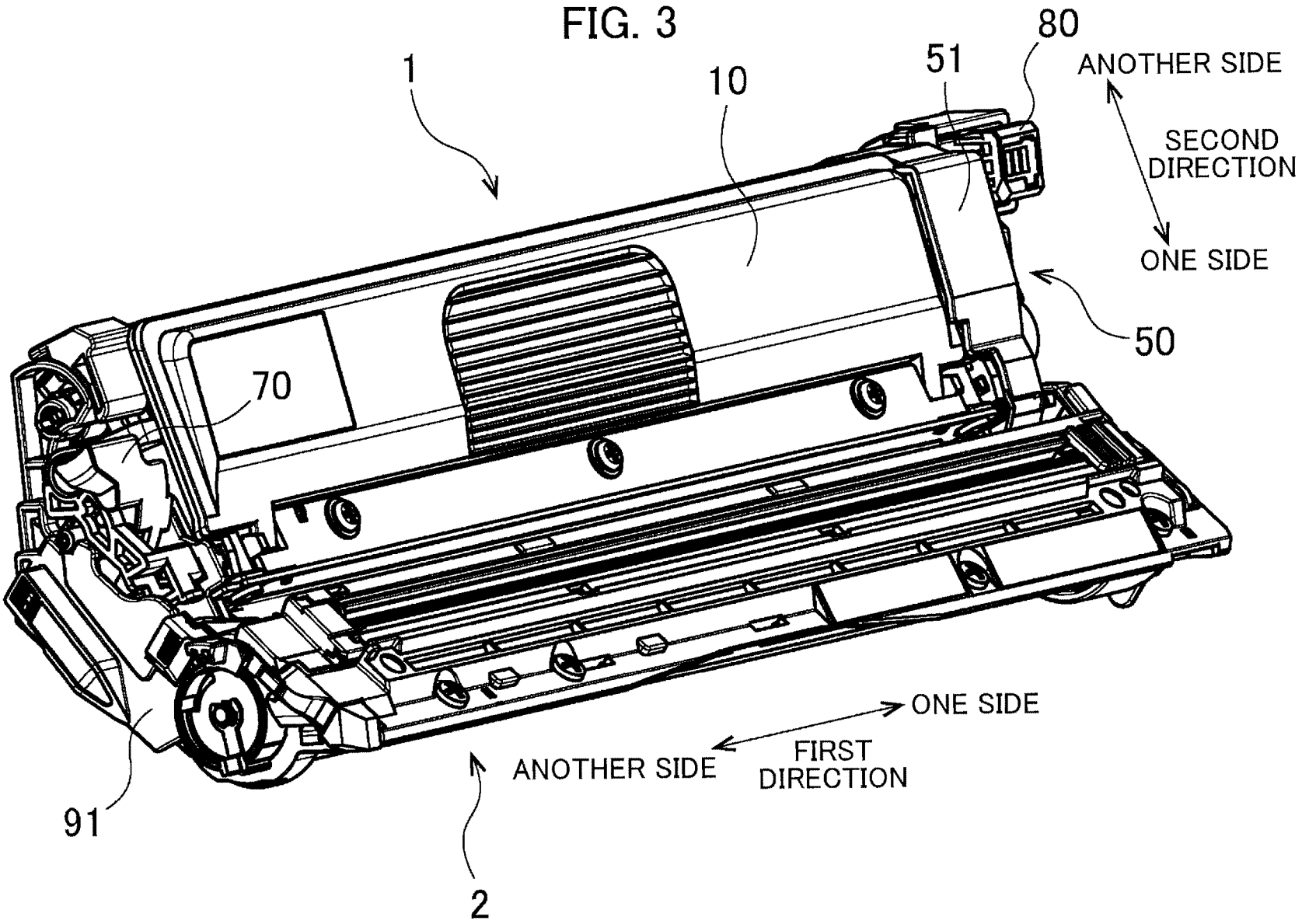
FIG. 3 is another perspective view illustrating the state of attachment of the developing cartridge to the drum cartridge.

FIG. 1 is a perspective view of the developing cartridge 1 and a drum cartridge 2. FIGS. 2 and 3 are perspective views illustrating a state where the developing cartridge 1 is attached to the drum cartridge 2.

The developing cartridge 1 and the drum cartridge 2 are used in an electro-photographic type image-forming apparatus such as a laser printer and an LED printer.

As illustrated in FIGS. 1 through 3, the developing cartridge 1 is for use with the drum cartridge 2. The developing cartridge 1 is attachable to the drum cartridge 2. The developing cartridge 1 is configured to be attached to an apparatus body of the image-forming apparatus in a state where the developing cartridge 1 is attached to the drum cartridge 2. In the present embodiment, a plurality of, for example, four developing cartridges 1 are attachable to the apparatus body of the image-forming apparatus. The four developing cartridges 1 respectively accommodate therein developing agent (for example, toner) of different colors such as cyan, magenta, yellow, and black. The image-forming apparatus is configured to form an image on a printing sheet with the developing agent supplied from the respective developing cartridges 1. Incidentally, the number of the developing cartridges 1 to be attached to the apparatus body of the image-forming apparatus may be from one to three, or not less than five.

2. Developing Cartridge

Figure 4:
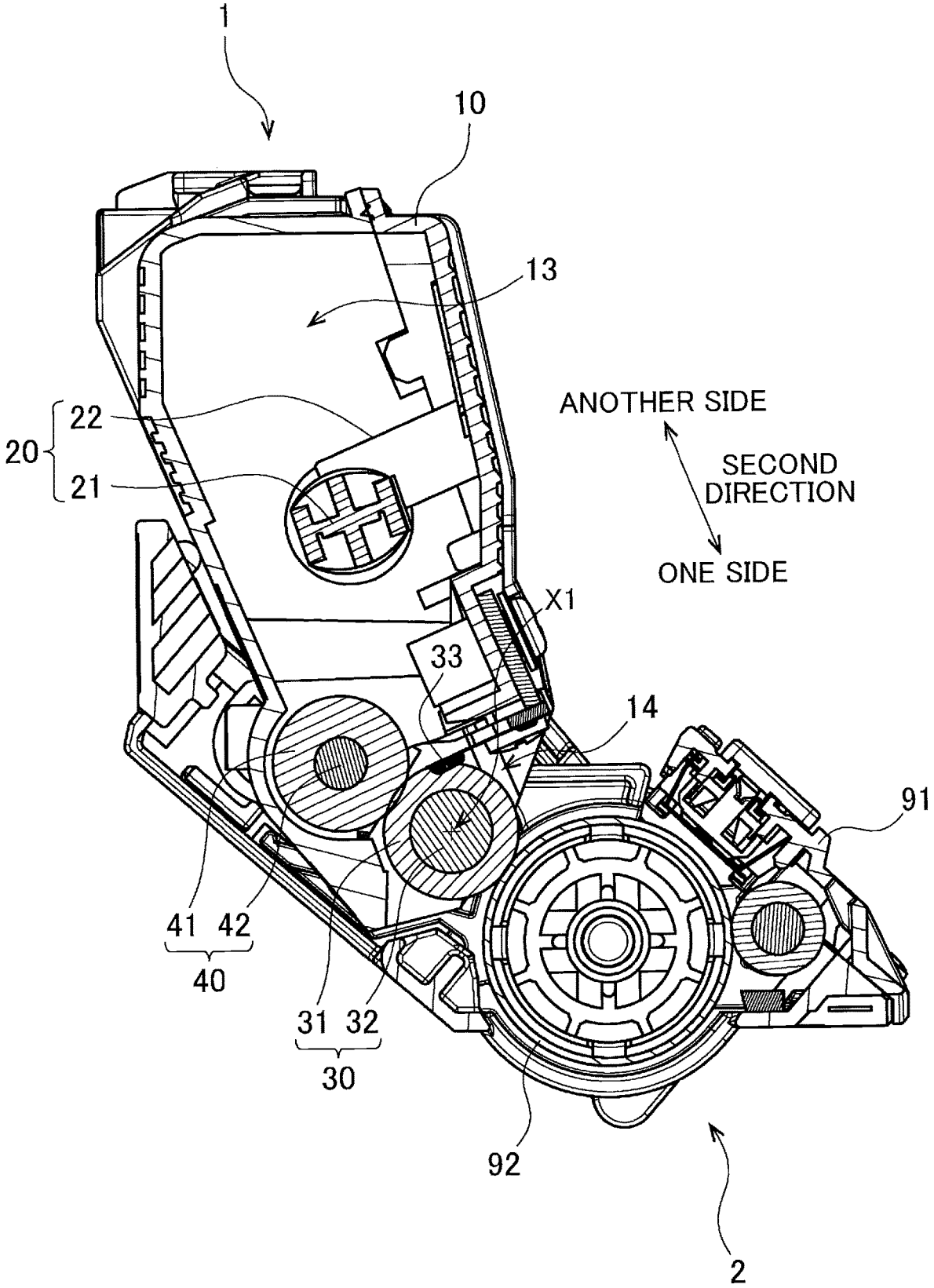
FIG. 4 is a cross-sectional view of the developing cartridge and the drum cartridge in the attached state taken along a plane perpendicular to a first direction.
Figure 5:
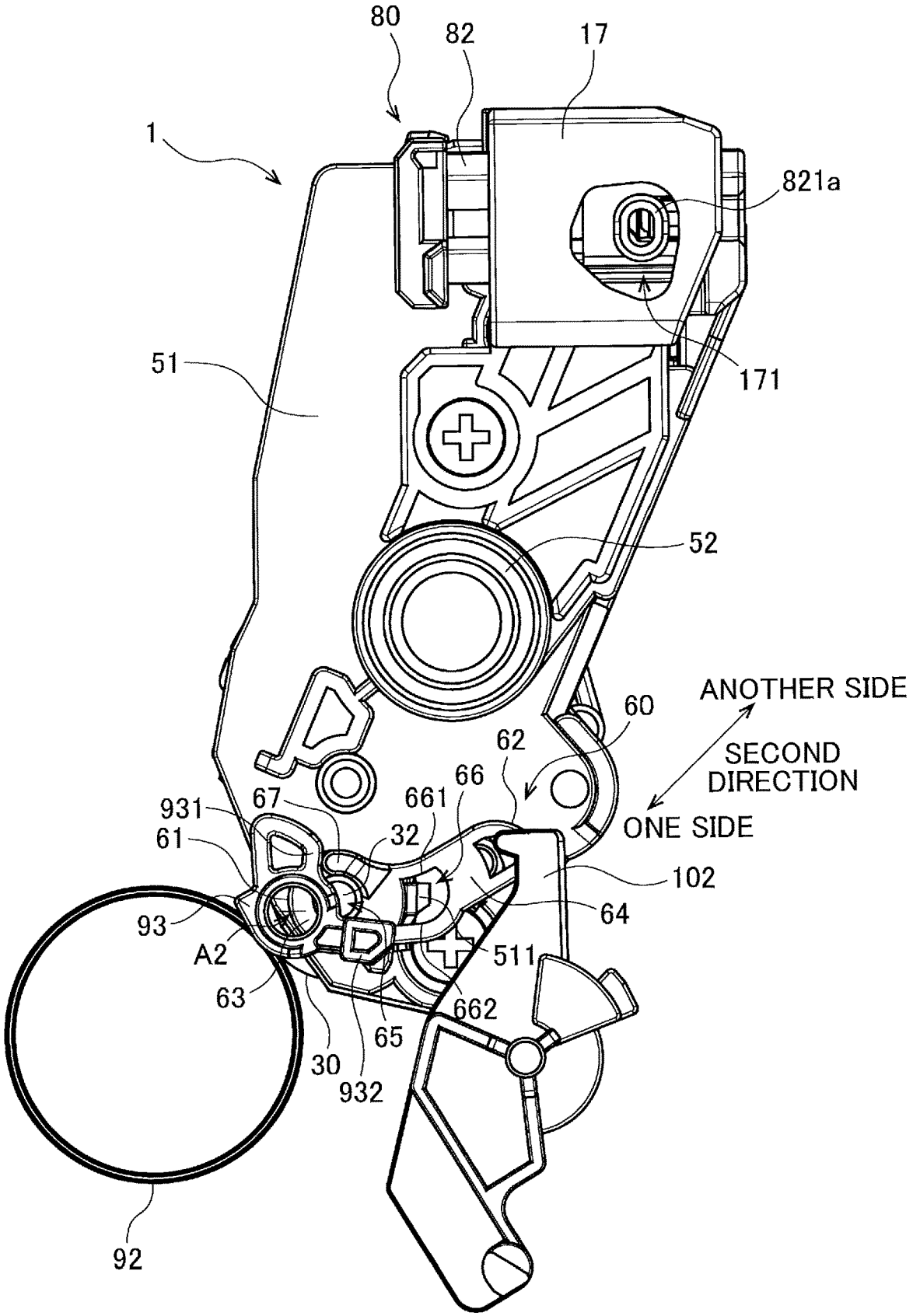
FIG. 5 is a view of the developing cartridge as viewed in the first direction from a first outer surface side of a casing.
Figure 6:
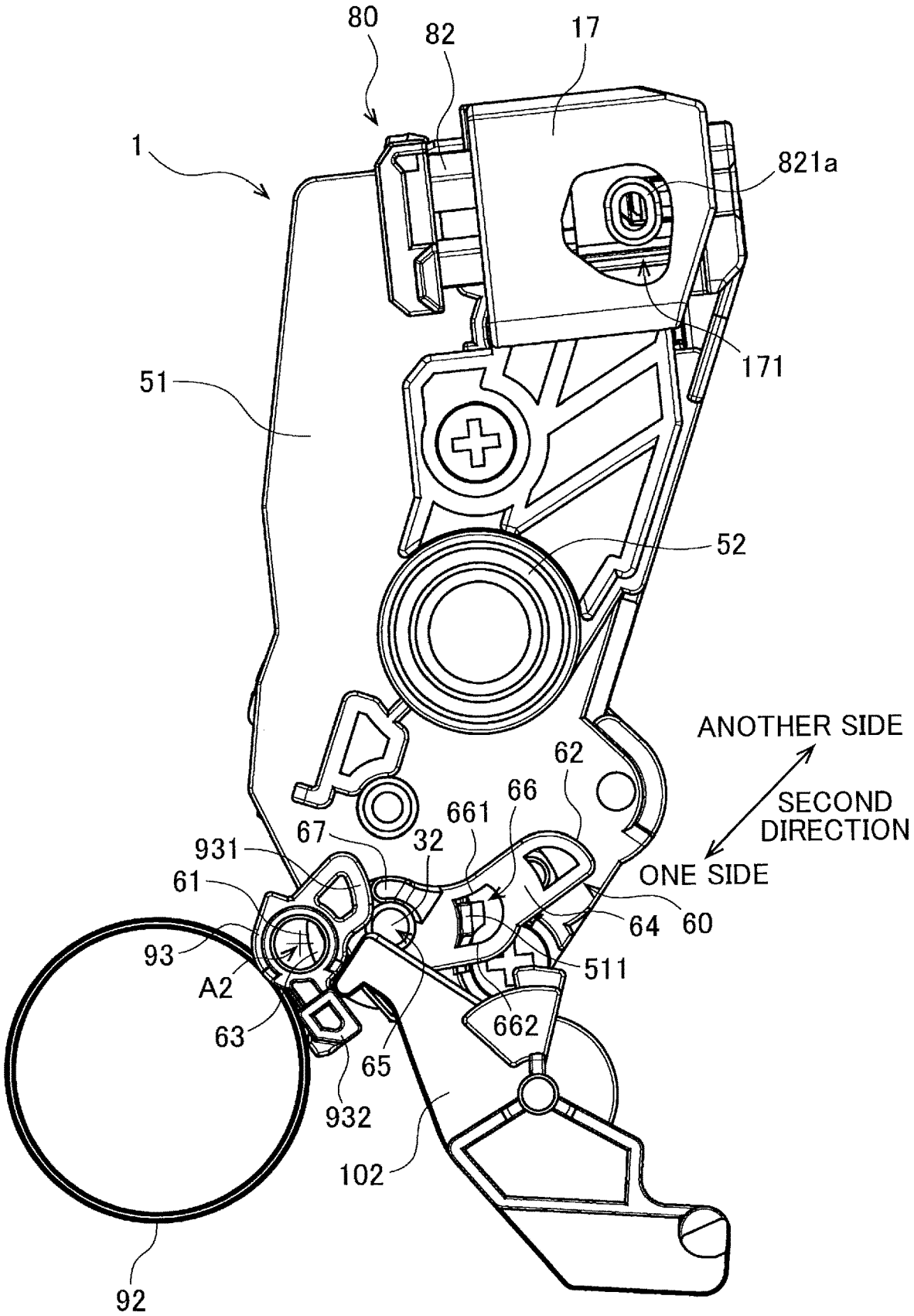
FIG. 6 is another view of the developing cartridge as viewed in the first direction from the first outer surface side of the casing.
Figure 7:
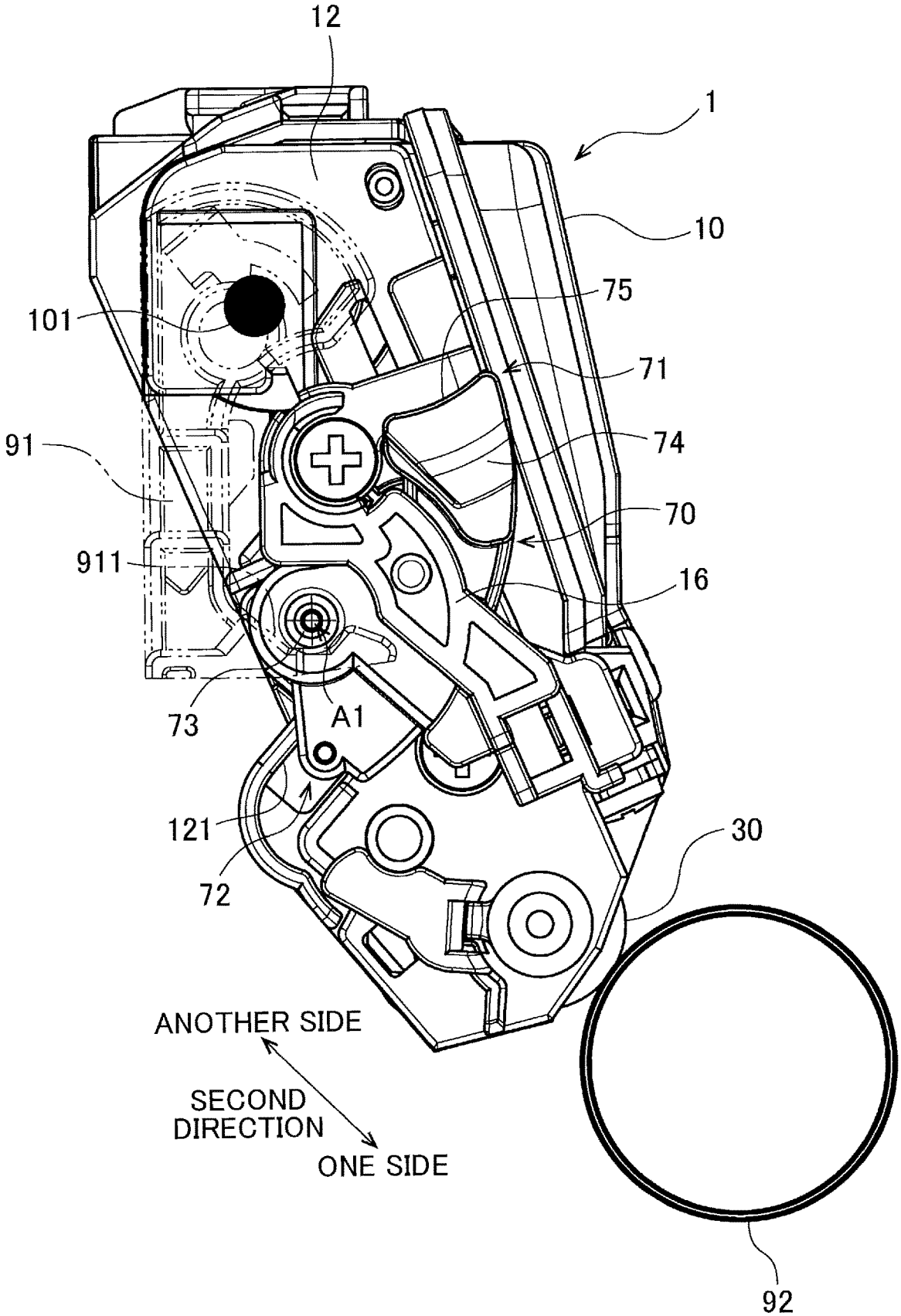
FIG. 7 is a view of the developing cartridge as viewed in the first direction from a second outer surface side of the casing.
Figure 8:
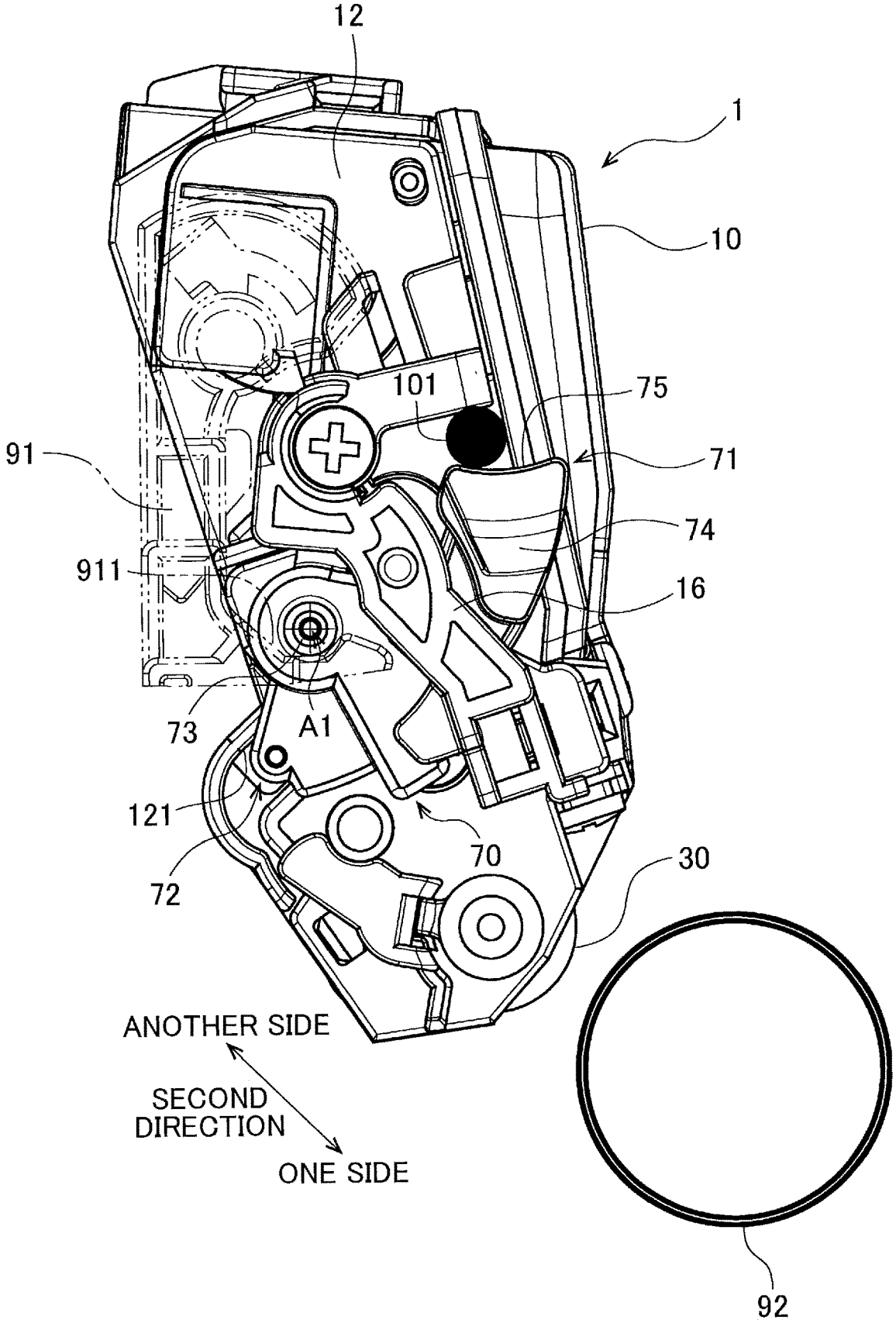
FIG. 8 is another view of the developing cartridge as viewed in the first direction from the second outer surface side of the casing.

FIG. 4 is a cross-sectional view of the developing cartridge 1 and the drum cartridge 2 in the attached state taken along a plane perpendicular to the first direction. FIGS. 5 and 6 are views of the developing cartridge 1 as viewed in the first direction from a first outer surface 11 side of a casing 10 those described later. FIGS. 7 and 8 are views of the developing cartridge 1 as viewed in the first direction from a second outer surface 12 side (described later) of the casing 10.

As illustrated in FIGS. 1 through 8, the developing cartridge 1 includes the casing 10, the agitator 20, the developing roller 30, a supply roller 40, a gear portion 50, a first separation member 60, a second separation member 70, and a memory assembly 80.

The casing 10 is configured to accommodate therein the developing agent. The casing 10 has the first outer surface 11 and the second outer surface 12. The first outer surface 11 is positioned at one end of the casing 10 in the first direction. The second outer surface 12 is positioned at another end of the casing 10 in the first direction. The first outer surface 11 and the second outer surface 12 are spaced apart from each other in the first direction. The casing 10 extends in the first direction between the first outer surface 11 and the second outer surface 12, and also extends in the second direction.

An accommodation chamber 13 is defined in the casing 10. The developing agent is accommodated in the accommodation chamber 13. The casing 10 has an opening 14 (FIG. 4). The opening 14 is positioned at one end portion of the casing 10 in the second direction. The accommodation chamber 13 is in communication with an outside of the casing 10 through the opening 14. Incidentally, a handle (not illustrated) may be positioned at an outer surface of another end portion of the casing 10 in the second direction.

The agitator 20 includes an agitator shaft 21 and a fin 22. The agitator shaft 21 extends in the first direction. The fin 22 extends from the agitator shaft 21 toward an inner surface of the casing 10. That is, the fin 22 extends radially outward from the agitator shaft 21. A part of the agitator shaft 21 and the fin 22 are positioned inside the accommodation chamber 13 of the casing 10.

The agitator shaft 21 has one end portion in the first direction to which an agitator gear of the gear portion 50 is attached. The agitator shaft 21 is fixed to the agitator gear. As the agitator gear rotates, the agitator shaft 21 and the fin 22 rotate about a rotation axis extending in the first direction. The rotation of the fin 22 causes agitation of the developing agent accommodated in the accommodation chamber 13.

The developing roller 30 is rotatable about a rotation axis X1 extending in the first direction. The developing roller 30 is positioned at the opening 14 of the casing 10. That is, the developing roller 30 is positioned at the one end portion of the casing 10 in the second direction. The developing roller 30 includes a developing roller body 31 and a developing roller shaft 32. The developing roller body 31 is a hollow cylindrical member extending in the first direction. The developing roller body 31 is made from elastic material such as rubber. The developing roller shaft 32 is a solid cylindrical member extending in the first direction throughout the developing roller body 31. The developing roller shaft 32 is electrically conductive. The developing roller shaft 32 is made from metal or electrically conductive resin.

The developing roller body 31 is fixed to the developing roller shaft 32. The developing roller body 31 has one end portion in the first direction to which a developing roller gear of the gear portion 50 is attached. The developing roller shaft 32 is fixed to the developing roller gear. Hence, as the developing roller gear rotates, the developing roller shaft 32 rotates and the developing roller body 31 also rotates together with the developing roller shaft 32.

Incidentally, the developing roller shaft 32 may not extend throughout an entire length of the developing roller body 31 in the first direction. For example, a developing roller shaft 31 may extend outward in the first direction from each end of the developing roller body 31 in the first direction.

The supply roller 40 is rotatable about a rotation axis extending in the first direction. The supply roller 40 is positioned between the agitator 20 and the developing roller 30. The supply roller 40 includes a supply roller body 41 and a supply roller shaft 42. The supply roller body 41 is a hollow cylindrical member extending in the first direction. The supply roller body 41 is made from elastic material such as rubber. The supply roller shaft 42 is a solid cylindrical member extending in the first direction throughout the supply roller body 41.

The supply roller body 41 is fixed to the supply roller shaft 42. Further, the supply roller shaft 42 has one end portion in the first direction to which a supply roller gear of the gear portion 50 is attached. The supply roller shaft 42 is fixed to the supply roller gear. With this structure, as the supply roller gear rotates, the supply roller shaft 42 rotates and the supply roller body 41 also rotates together with the supply roller shaft 42.

Incidentally, the supply roller shaft 42 may not extend throughout an entire length of the supply roller body 41 in the first direction. For example, a supply roller shaft 42 may extend outward in the first direction from each end of the supply roller body 41 in the first direction.

Upon receipt of driving force in the developing cartridge 1, the developing agent in the accommodation chamber 13 of the casing 10 is supplied to an outer peripheral surface of the developing roller 30 through the supply roller 40. At this time, the developing agent is triboelectrically charged between the supply roller 40 and the developing roller 30. In the meantime, a bias voltage is applied to the developing roller shaft 32 of the developing roller 30. Hence, the developing agent is attracted to the outer peripheral surface of the developing roller body 31 because of electrostatic force between the developing roller shaft 32 and the developing agent.

The developing cartridge 1 further includes a layer thickness regulating blade 33. The layer thickness regulating blade 33 is configured to regulate a thickness of a layer of the developing agent formed on the outer peripheral surface of the developing roller body 31 into a uniform thickness. After the regulation, the developing agent on the outer peripheral surface of the developing roller body 31 is supplied to a photosensitive drum 92 (described later) of the drum cartridge 2. At this time, the developing agent moves from the developing roller body 31 to the photosensitive drum 92 in conformity with an electrostatic latent image formed on the outer peripheral surface of the photosensitive drum 92. Hence, the electrostatic latent image becomes a visible image on the outer peripheral surface of the photosensitive drum 92.

The gear portion 50 is positioned at the first outer surface 11 of the casing 10. The gear portion 50 includes a gear cover 51, a coupling 52, and a plurality of gears. A combination of the gear cover 51 and the casing 10 constitutes a housing of the developing cartridge 1. The gear cover 51 is fixed to the first outer surface 11 of the casing 10 by, for example, screw-fixing. The plurality of gears includes the agitator gear, the developing roller gear, and the supply roller gear described above. At least part of the plurality of gears is positioned between the first outer surface 11 and the gear cover 51.

The coupling 52 has an engagement part 521 recessed inward in the first direction. The engagement part 521 is exposed to the outside through the gear cover 51. On the other hand, the image-forming apparatus includes a drive shaft connectable to the engagement part 521 of the coupling 52 upon attachment of the developing cartridge 1 (which is attached to the drum cartridge 2) to the image-forming apparatus, so that a rotation of the drive shaft is transmitted to the agitator gear, the developing roller gear, and the supply roller gear through the coupling 52.

Incidentally, the plurality of gears of the gear portion 50 may be configured to transmit the rotation of the drive shaft through meshing engagement of gear teeth or through frictional force generated by neighboring friction members.

The first separation member 60 is positioned at the first outer surface 11 of the casing 10. Specifically, the first separation member 60 is positioned at an outer surface of the gear cover 51. As illustrated in FIGS. 5 and 6, the first separation member 60 has one end portion 61 and another end portion 62. The other end portion 62 is positioned farther from the developing roller shaft 32 than the one end portion 61 is from the developing roller shaft 32. Further, the other end portion 62 is positioned farther from one end of the casing 10 in the second direction than the one end portion 61 is from the one end in the second direction. The first separation member 60 extends along the first outer surface 11 of the casing 10 between the one end portion 61 and the other end portion 62.

The first separation member 60 includes a first arm 63 and a second arm 64. The second arm 64 is positioned farther from the developing roller shaft 32 than the first arm 63 is from the developing roller shaft 32. Further, the second arm 64 is positioned farther from the one end in the second direction of the casing 10 than the first arm 63 is from the one end in the second direction.

The first arm 63 has the one end portion 61. The second arm 64 has the other end portion 62. The first arm 63 extends linearly along the first outer surface 11 of the casing 10. The second arm 64 extends linearly along the first outer surface 11 of the casing 10. The first arm 63 is bent (inclined) relative to the second arm 64 to define an obtuse angle therebetween.

According to the present embodiment, the first arm 63 and the second arm 64 are integral with each other. Alternatively, the first arm 63 and the second arm 64 may be independent components, provided that the first arm 63 and second arm 64 are fixed to each other.

The first separation member 60 has a shaft hole 65. The shaft hole 65 is positioned at the one end portion 61 of the first separation member 60 and extends in the first direction. The shaft hole 65 is a through-hole extending throughout a thickness of the one end portion 61 in the first direction. Alternatively, the shaft hole 65 may be in a form of a recess at the one end portion 61. The shaft hole 65 has a cylindrical inner peripheral surface. The one end portion in the first direction of the developing roller shaft 32 is inserted in the shaft hole 65. Hence, the one end portion in the first direction of the developing roller shaft 32 is rotatably supported by the one end portion 61 of the first separation member 60 such that the developing roller shaft 32 is rotatable about the rotation axis X1 extending in the first direction. Further, the first separation member 60 is pivotally movable with respect to the casing 10 about the developing roller shaft 32. Specifically, the other end portion 62 of the first separation member 60 is pivotally movable about the developing roller shaft 32.

The first separation member 60 is an electrode having electrical conductivity. The first separation member 60 is made from, for example, an electrically conductive resin. Alternatively, the first separation member 60 may be made from metal. The one end portion 61 of the first separation member 60 is in contact with the one end portion in the first direction of the developing roller shaft 32. Hence, the one end portion 61 of the first separation member 60 is electrically connected to the developing roller shaft 32. Upon attachment of the drum cartridge 2 (to which the developing cartridge 1 is attached) to the apparatus body, the apparatus body supplies a bias voltage to the developing roller shaft 32 through the first separation member 60. Incidentally, the first separation member 60 may be made from electrically non-conductive resin.

As illustrated in FIGS. 5 and 6, the first separation member 60 has a stopper hole 66. The stopper hole 66 is a through-hole extending throughout the thickness of the first separation member 60 in the first direction. Alternatively, the stopper hole 66 may be a recess that is recessed in the first direction. The stopper hole 66 has a first stopper surface 661 and a second stopper surface 662. The first stopper surface 661 and the second stopper surface 662 are spaced away from each other in a pivoting direction of the other end portion 62 about the developing roller shaft 32.

On the other hand, the gear cover 51 includes a stop protrusion 511. The stop protrusion 511 protrudes from the outer surface of the gear cover 51 outward in the first direction toward the first separation member 60. The stop protrusion 511 is inserted in the stopper hole 66.

The first separation member 60 is pivotally movable about the developing roller shaft 32 between a first pivot position and a second pivot position. The stop protrusion 511 contacts the first stopper surface 661 when the first separation member 60 is at the first pivot position. On the other hand, the stop protrusion 511 contacts the second stopper surface 662 when the first separation member 60 is at the second pivot position. By the stop protrusion 511 inserted in the stopper hole 66, a pivoting range of the first separation member 60 is restricted.

The first separation member 60 further includes a protrusion 67. The protrusion 67 protrudes outward from the one end portion 61 of the first separation member 60 in the first direction. The protrusion 67 of the first separation member 60 makes contact with a drum cam 93 (described later) of the drum cartridge 2 in the attached state of the developing cartridge 1 to the drum cartridge 2. The protrusion 67 can receive a pressing force from the drum cam 93 in the attached state of the developing cartridge 1 to the drum cartridge 2.

Figure 9:
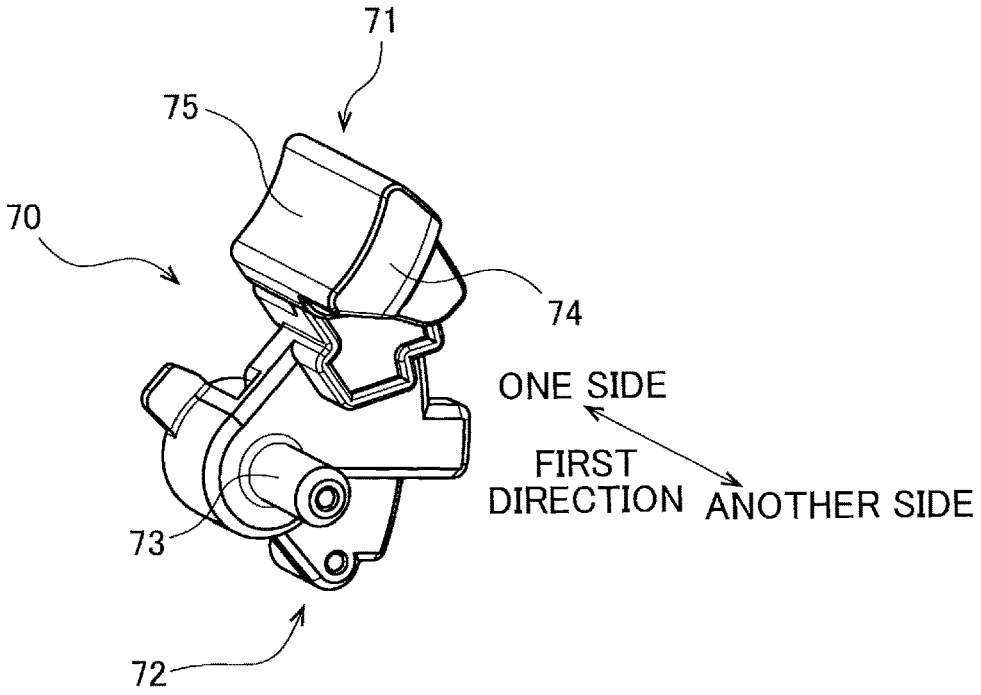
FIG. 9 is a perspective view of a second separation member in the developing cartridge according to the embodiment.
Figure 10:
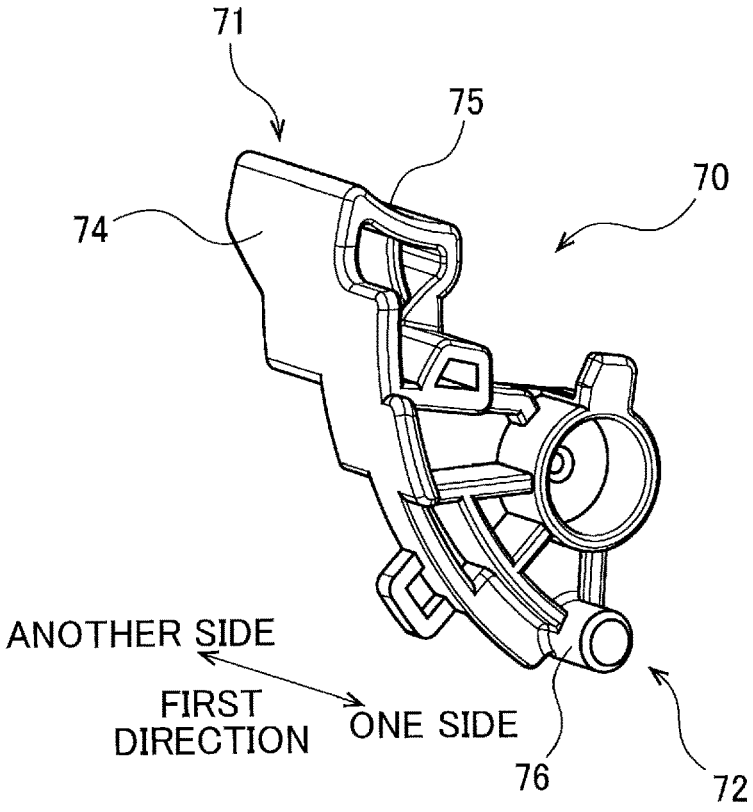
FIG. 10 is another perspective view of the second separation member.

The second separation member 70 is positioned at the second outer surface 12 of the casing 10. FIGS. 9 and 10 are perspective views of the second separation member 70. As illustrated in FIGS. 7 through 10, the second separation member 70 includes a first end portion 71, a second end portion 72, and a shaft portion 73.

The second end portion 72 is one end portion of the second separation member 70 in the second direction. The first end portion 71 is another end portion of the second separation member 70 in the second direction. The first end portion 71 is positioned farther from the developing roller 30 than the second end portion 72 is from the developing roller 30 in the second direction. The shaft portion 73 is positioned between the first end portion 71 and the second end portion 72 in the second direction. The shaft portion 73 protrudes from the second separation member 70 along a first axis A1 extending in the first direction.

The first end portion 71 includes a first convex portion 74. The first convex portion 74 protrudes from the first end portion 71 in the first direction away from the second outer surface 12 of the casing 10. The first convex portion 74 has a concave surface 75. The concave surface 75 is concaved toward the photosensitive drum 92 of the drum cartridge 2 in the attached state of the developing cartridge 1 to the drum cartridge 2. Further, the second end portion 72 of the second separation member 70 includes a second convex portion 76. The second convex portion 76 protrudes from the second end portion 72 in the first direction toward the second outer surface 12 of the casing 10.

The second separation member 70 is movable relative to the casing 10. The shaft portion 73 is contactable with a drum frame 91 (described later) of the drum cartridge 2 in the attached state of the developing cartridge 1 to the drum cartridge 2. The second separation member 70 is pivotally movable between a first position and a second position about an axis of the shaft portion 73, i.e., about the first axis A1.

The second outer surface 12 of the casing 10 has a pressure receiving surface 121. The pressure receiving surface 121 faces the second end portion 72 of the second separation member 70 in the second direction. Specifically, the pressure receiving surface 121 faces the second convex portion 76 of the second separation member 70 in the second direction. The second end portion 72 is configured to contact the pressure receiving surface 121 by the pivotal movement of the second separation member 70 about the axis of the shaft portion 73 (first axis A1).

The developing cartridge 1 also includes a holder 16. The holder 16 is positioned on the second outer surface 12 of the casing 10. Specifically, the holder 16 is fixed to the second outer surface 12 of the casing 10 by, for example, screw-fixing. A part of the second separation member 70 is positioned between the second outer surface 12 of the casing 10 and the holder 16. Further, the holder 16 is positioned between the first convex portion 74 and the second convex portion 76 of the second separation member 70 in the second direction. The first convex portion 74 and the holder 16 face each other in the second direction so as to be capable of making contact with each other. This structure can prevent the second separation member 70 from coming off the holder 16 in the second direction. That is, the holder 16 movably holds the second separation member 70 relative to the casing 10.

Figure 11:
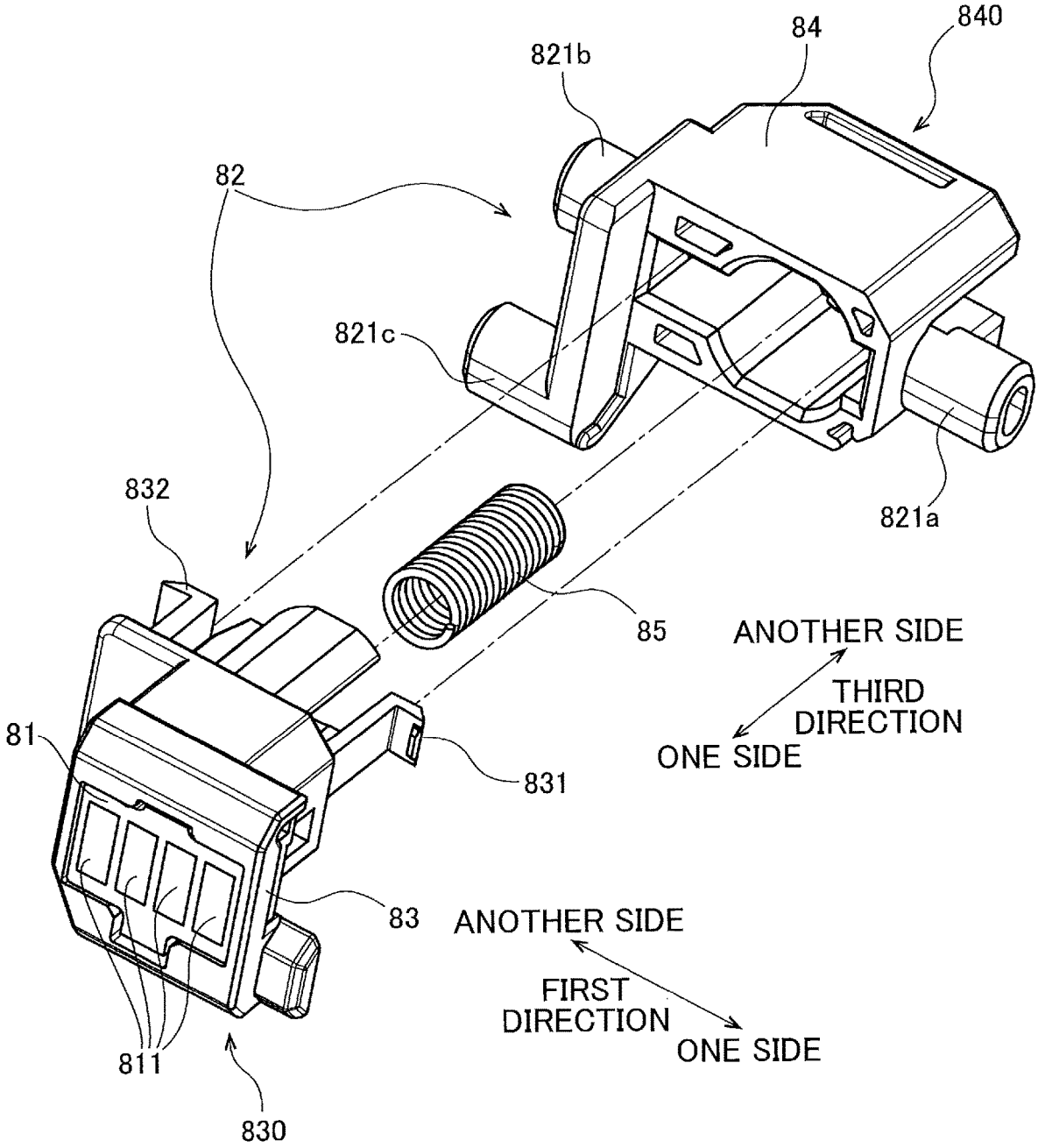
FIG. 11 is an exploded perspective view of a memory assembly in the developing cartridge according to the embodiment.

The memory assembly 80 is positioned at the first outer surface 11 of the casing 10. FIG. 11 is an exploded perspective view of the memory assembly 80. As illustrated in FIG. 11, the memory assembly 80 includes a memory (IC chip) 81 as a storage medium, and a memory holder 82 holding the memory 81. The memory 81 is positioned on an outer surface of the memory holder 82.

The memory 81 is configured to store various information about the developing cartridge 1. Specifically, the memory 81 stores information including at least one of: a cumulative number of printed sheets using the developing roller 30; a cumulative rotation number of the developing roller 30; and a cumulative consumption amount of the developing agent. Such information is indicative of a remaining service life of the developing cartridge 1. Further, the memory 81 may be further configured to store information about a serial number of the developing cartridge 1 and a matching model(s) to be used with the developing cartridge 1. The memory 81 has electrical contact surfaces 811. The electrical contact surfaces 811 are made from metal as an electrically conductive material.

As illustrated in FIGS. 5 and 6, the developing cartridge 1 further includes a holder cover 17. The holder cover 17 is positioned at the first outer surface 11 of the casing 10. Specifically, the holder cover 17 is fixed to the outer surface of the gear cover 51 by, for example, screw-fixing. The memory holder 82 is positioned between the gear cover 51 and the holder cover 17.

The memory holder 82 includes a first boss 821*a*, a second boss 821*b*, and a third boss 821*c*. The first boss 821*a* extends outward in the first direction toward the holder cover 17 from a surface of the memory holder 82, the surface facing the holder cover 17. On the other hand, the holder cover 17 has a first hole 171. The first hole 171 is a through-hole extending throughout a thickness of the holder cover 17 in the first direction. The first boss 821*a* of the memory holder 82 is inserted in the first hole 171.

The second boss 821*b* and the third boss 821*c* extend inward in the first direction toward the gear cover 51 from a surface of the memory holder 82, the surface facing the gear cover 51. On the other hand, the gear cover 51 has a second hole (not illustrated) and a third hole (not illustrated). The second hole and the third hole are through-holes extending in the first direction throughout a thickness of the gear cover 51 or may be recesses recessed in the first direction in the gear cover 51. The second boss 821*b* of the memory holder 82 is inserted in the second hole, and the third boss 821*c* of the memory holder 82 is inserted in the third hole.

Incidentally, the first boss 821*a*, the second boss 821*b*, and the third boss 821*c* may have a solid cylindrical shape, or may have other shape such as a prismatic columnar shape.

The first hole 171 has a size (internal size) in the second direction greater than a size (external size) in the second direction of the first boss 821*a*. The second hole has a size (internal size) in the second direction greater than a size (external size) in the second direction of the second boss 821*b*. The third hole has a size (internal size) in the second direction greater than a size (external size) in the second direction of the third boss 821*c*. Hence, the memory holder 82 is movable in the second direction together with the first boss 821*a*, the second boss 821*b*, and the third boss 821*c* relative to the casing 10, the gear cover 51, and the holder cover 17. As the memory holder 82 moves in the second direction relative to the casing 10, the memory 81 having the electrical contact surfaces 811 also moves in the second direction together with the memory holder 82 relative to the casing 10.

As illustrated in FIG. 11, the memory holder 82 has a first outer surface 830 and a second outer surface 840. The first outer surface 830 is one end of the memory holder 82 in a third direction crossing the electrical contact surface 811. The second outer surface 840 is another end of the memory holder 82 in the third direction. The second outer surface 840 is movable in the third direction relative to the first outer surface 830.

Specifically, the memory holder 82 according to the present embodiment includes a first holder member 83, a second holder member 84, and a coil spring 85 positioned therebetween. The first holder member 83 is made from, for example, resin. The second holder member 84 is made from, for example, resin. The first holder member 83 has the first outer surface 830. The memory 81 is fixed to the first outer surface 830. The second holder member 84 has the second outer surface 840. The first outer surface 830 and the second outer surface 840 are spaced apart from each other in the third direction upon assembly of the memory holder 82.

The coil spring 85 is a resiliently urging member extending in the third direction. The coil spring 85 is configured to expand and compress in the third direction between a first state and a second state more compressed than the first state. That is, the coil spring 85 has a length in the third direction greater in the first state than in the second state. Hence, a distance between the first outer surface 830 and the second outer surface 840 in the third direction is greater in the first state of the coil spring 85 than in the second state of the coil spring 85. Further, at least the length in the third direction of the coil spring 85 in the second state is smaller than a natural length of the coil spring 85.

Further, as illustrated in FIG. 11, the first holder member 83 has a first pawl 831 and a second pawl 832. The first pawl 831 and the second pawl 832 protrude from the first holder member 83 respectively in directions crossing the third direction. On the other hand, the second holder member 84 has a first pawl receiving portion (not illustrated) and a second pawl receiving portion (not illustrated). The first and second pawl receiving portions may be openings, or recessed portions or stepped portions those formed in an inner surface of the second holder member 84.

The first pawl 831 is configured to make contact with the first pawl receiving portion. The second pawl 832 is configured to make contact with the second pawl receiving portion. The first pawl 831 contacts the first pawl receiving portion when the coil spring 85 is in the first state. The second pawl 832 contacts the second pawl receiving portion when the coil spring 85 is in the first state. Hence, in the first state of the coil spring 85, the length of the coil spring 85 in the third direction can be maintained and is prevented from getting further longer. On the other hand, the first pawl 831 is released from the first pawl receiving portion, and the second pawl 832 is released from the second pawl receiving portion when the coil spring 85 is in the second state.

Incidentally, the second holder member 84 may have the pawls and the first holder member 83 may have the pawl receiving portions.

3. Drum Cartridge

As illustrated in FIGS. 1 through 4, the drum cartridge 2 incudes the drum frame 91, and the photosensitive drum 92. The developing cartridge 1 is attachable to the drum frame 91. The photosensitive drum 92 is a hollow cylindrical member rotatable about a rotation axis extending in the first direction. The photosensitive drum 92 has an outer peripheral surface covered with a photosensitive material. The photosensitive drum 92 is positioned at one end portion of the drum frame 91 in the second direction.

Upon attachment of the developing cartridge 1 to the drum frame 91, the outer peripheral surface of the developing roller 30 makes contact with the outer peripheral surface of the photosensitive drum 92. At this time, the developing roller 30 is urged in the second direction toward the photosensitive drum 92 by a resiliently urging member (not illustrated) provide at the drum cartridge 2.

Further, as illustrated in FIGS. 2, 5 and 6, the drum cartridge 2 also includes the drum cam 93. The drum cam 93 is positioned at one end of the drum frame 91 in the first direction. The drum cam 93 is pivotally movable about a second axis A2 extending in the first direction.

The drum cam 93 includes a first protrusion 931 and a second protrusion 932. The first protrusion 931 extends radially outwardly with respect to the second axis A2 of the drum cam 93. The second protrusion 932 extends radially outwardly with respect to the second axis A2 of the drum cam 93 and in a direction different from an extending direction of the first protrusion 931. The first protrusion 931 of the drum cam 93 faces the protrusion 67 of the second separation member 70 in the second direction upon attachment of the developing cartridge 1 to the drum cartridge 2.

FIGS. 7 and 8 illustrate a part of the drum frame 91 that is indicated by two-dotted chain lines. As illustrated in FIGS. 7 and 8, the drum frame 91 has a recessed portion 911. The recessed portion 911 is positioned at another end of the drum frame 91 in the first direction. The recessed portion 911 is recessed in the second direction toward the photosensitive drum 92. The shaft portion 73 of the second separation member 70 is fitted with the recessed portion 911 upon attachment of the developing cartridge 1 to the drum cartridge 2. In the attached state of the developing cartridge 1 to the drum cartridge 2, the shaft portion 73 contacts the recessed portion 911 such that the shaft portion 73 is positioned opposite to the photosensitive drum 92 with respect to the recessed portion 911. That is, the shaft portion 73 contacts the recessed portion 911 in the second direction toward the photosensitive drum 92 in the attached state of the developing cartridge 1 to the drum cartridge 2.

4. Separating Operation

After the attachment, to the image-forming apparatus, of the drum cartridge 2 to which the developing cartridge 1 is attached, a separating operation can be performed at the developing cartridge 1 by the driving force supplied from the image-forming apparatus. By the separating operation, the developing roller 30 is temporarily separated from the photosensitive drum 92. For example, in order to perform monochromatic printing in the image-forming apparatus, the separating operation is performed with respect to the developing cartridges 1 for the colors other than black. However, the separating operation may also be performed with respect to the developing cartridge 1 for the color of black.

FIG. 5 illustrates a state at the first outer surface 11 of the casing 10 where the separating operation is not performed. FIG. 6 illustrates another state at the first outer surface 11 of the casing 10 where the separating operation is performed. As illustrated in FIGS. 5 and 6, the apparatus body of the image-forming apparatus has a body-side lever 102. The body-side lever 102 is movable with respect to the apparatus body between a third position illustrated in FIG. 5 and a fourth position illustrated in FIG. 6.

As illustrated in FIG. 5, the body-side lever 102 is separated from the drum cam 93 when the body-side lever 102 is at the third position in the state where the drum cartridge 2 is attached to the apparatus body in the attached state of the developing cartridge 1 to the drum cartridge 2. On the other hand, as illustrated in FIG. 6, the body-side lever 102 is in contact with the second protrusion 932 of the drum cam 93 when the body-side lever 102 is at the fourth position in the state where the drum cartridge 2 is attached to the apparatus body in the attached state of the developing cartridge 1 to the drum cartridge 2. At this time, the body-side lever 102 pushes the second protrusion 932 in the second direction toward the photosensitive drum 92. That is, the drum cam 93 receives the driving force from the body-side lever 102.

As a result, the drum cam 93 is caused to pivotally move about the second axis A2 extending in the first direction relative to the photosensitive drum 92. The first protrusion 931 of the drum cam 93 is thus brought into abutment with the protrusion 67 of the first separation member 60, thereby causing the first protrusion 931 of the drum cam 93 to push the first separation member 60 in a direction away from the photosensitive drum 92 in the second direction.

FIG. 7 illustrates a state at the second outer surface 12 of the casing 10 where the separating operation is not performed. FIG. 8 illustrates another state at the second outer surface 12 of the casing 10 where the separating operation is performed. As illustrated in FIGS. 7 and 8, the apparatus body of the image-forming apparatus includes a body-side cam 101. The body-side cam 101 is movable relative to the apparatus body between a fifth position illustrated in FIG. 7 and a sixth position illustrated in FIG. 8.

In the state where the drum cartridge 2 is attached to the apparatus body in the attached state of the developing cartridge 1 to the drum cartridge 2, the body-side cam 101 is separated from the second separation member 70 when the body-side cam 101 is at the fifth position, as illustrated in FIG. 7. On the other hand, as illustrated in FIG. 8, the body-side cam 101 is in contact with the first end portion 71 of the second separation member 70 when the body-side cam 101 is at the sixth position in the state where the drum cartridge 2 is attached to the apparatus body in the attached state of the developing cartridge 1 to the drum cartridge 2. Specifically, the body-side cam 101 is brought into abutment with the concave surface 75 of the second separation member 70, and pushes the second separation member 70 in the second direction toward the photosensitive drum 92.

As a result, the second separation member 70 is caused to pivotally move about the axis of the shaft portion 73. That is, the second separation member 70 is pivotally moved about the first axis A1 relative to the developing roller 30. The second end portion 72 of the second separation member 70 is thus brought into abutment with the pressure receiving surface 121 of the casing 10, so that the second end portion 72 of the second separation member 70 presses the pressure receiving surface 121 of the casing 10 in the second direction away from the photosensitive drum 92.

As described above, the drum cam 93 pushes the first separation member 60 in the direction away from the photosensitive drum 92 at the first outer surface 11 of the casing 10. Further, the body-side cam 101 pushes the second separation member 70, so that the second separation member 70 pushes the casing 10 in the direction away from the photosensitive drum 92 at the second outer surface 12 of the casing 10. As such, the casing 10 and the developing roller 30 can be moved from a contacting position where the developing roller 30 is in contact with the photosensitive drum 92 to a separating position where the developing roller 30 is separated from the photosensitive drum 92.

In this way, the casing 10 and the developing roller 30 are pressed in the direction away from the photosensitive drum 92 by different separation mechanisms between at the first outer surface 11 of the casing 10 and at the second outer surface 12 of the casing 10. Thus, spaces at the first outer surface 11 and at the second outer surface 12 can be efficiently utilized due to the difference in the separation mechanisms between at the first outer surface 11 and at the second outer surface 12 of the casing 10.

Further, in the second separation member 70 according to the present embodiment, the first end portion 71 is pressed toward the photosensitive drum 92 by the body-side cam 101 in the separating operation. Hence, the shaft portion 73 of the second separation member 70 presses the drum cartridge 2 toward the photosensitive drum 92 because of the contact of the shaft portion 73 with the recessed portion 911 of the drum cartridge 2. This structure can prevent the drum cartridge 2 from being moved in the direction away from the photosensitive drum 92 together the developing cartridge 1 in the separating operation.

Further, the memory assembly 80 and the first separation member 60 , which are movable relative to the casing 10, are positioned at the first outer surface 11 of the casing 10, whereas the second separation member 70 movable relative to the casing 10 is positioned at the second outer surface 12 of the casing 10. Since the components movable relative to the casing 10 are positioned separately at the first outer surface 11 and the second outer surface 12, respectively, the space at each end of the casing 10 in the first direction can be efficiently utilized.

5. Modifications

In the above-described embodiment, the developing cartridge 1 is configured to be attached to the drum cartridge 2 having a single photosensitive drum 92. However, the developing cartridge 1 may be configured to be attached to a drum cartridge having a plurality of photosensitive drums.

While the description has been made in detail with reference to the specific embodiment and modifications, it would be apparent to those skilled in the art that various changes and modifications may be made therein without departing from the scope of the disclosure as long as no conflict is incurred.

<Remarks>

The developing cartridge 1 is an example of a developing cartridge. The drum cartridge 2 is an example of a drum cartridge. The photosensitive drum 92 is an example of a photosensitive drum. The developing roller 30 is an example of a developing roller. The casing 10 is an example of a casing. The first outer surface 11 is an example of a first outer surface of the casing, and the second outer surface 12 is an example of a second outer surface of the casing. The first separation member 60 is an example of a first separation member. The second separation member 70 is an example of a second separation member. The first end portion 71 is an example of a first end portion of the second separation member. The second end portion 72 is an example of a second end portion of the second separation member. The shaft portion 73 is an example of a shaft portion of the second separation member. The first axis A1 is an example of a first axis. The second axis A2 is an example of a second axis. The memory 81 is an example of a storage medium. The electrical contact surfaces 811 are an example of an electrical contact surface of the storage medium. The drum cam 93 is an example of a drum cam. The body-side cam 101 is an example of a body-side cam of an apparatus body of an image-forming apparatus.

What is claimed is:

1. A developing cartridge configured to be attached to an apparatus body of an image-forming apparatus including a body-side cam in an attached state of the developing cartridge to a drum cartridge including a photosensitive drum and a drum cam, the developing cartridge comprising:

a developing roller rotatable about a rotation axis extending in a first direction;

a casing configured to accommodate therein developing agent, the casing having a first outer surface and a second outer surface spaced apart from the first outer surface in the first direction, the developing roller being movable between a contacting position where the developing roller is in contact with the photosensitive drum and a separated position where the developing roller is separated from the photosensitive drum;

a first separation member positioned at the first outer surface and configured to make contact with the drum cam in a state where the drum cartridge is attached to the apparatus body in the attached state of the developing cartridge to the drum cartridge; and a second separation member positioned at the second outer surface and having a first end portion configured to make contact with the body-side cam in the state where the drum cartridge is attached to the apparatus body in the attached state of the developing cartridge to the drum cartridge, wherein the first separation member is configured to be pressed by the drum cam, and the first end portion of the second separation member is configured to be pressed by the body-side cam to move the developing roller from the contacting position to the separated position in the state where the drum cartridge is attached to the apparatus body in the attached state of the developing cartridge to the drum cartridge.

2. The developing cartridge according to claim 1, wherein the second separation member further has a second end portion configured to make contact with the casing, and wherein the second separation member is pivotally movable about a first axis extending in the first direction relative to the developing roller by pressure applied from the body-side cam to the first end portion of the second separation member, to cause the second end portion to move the casing in a direction away from the photosensitive drum.

3. The developing cartridge according to claim 2, wherein the second separation member further has a shaft portion defining an axis coincident with the first axis, wherein the shaft portion is configured to contact the drum cartridge in the attached state of the developing cartridge to the drum cartridge, and wherein the second separation member is configured to be pivotally moved about the axis of the shaft portion by the pressure applied from the body-side cam to the first end portion of the second separation member.

4. The developing cartridge according to claim 3, wherein the shaft portion is positioned to make contact with the drum cartridge in a direction toward the photosensitive drum, and wherein the first end portion of the second separation member is configured to be pressed by the body-side cam in the direction toward the photosensitive drum in the state where the drum cartridge is attached to the apparatus body in the attached state of the developing cartridge to the drum cartridge.

5. The developing cartridge according to claim 2, wherein the second outer surface of the casing has a pressure receiving surface, and wherein the second end portion has a convex portion facing the pressure receiving surface, the convex portion being configured to contact and push the pressure receiving surface to move the casing in the direction away from the photosensitive drum.

6. The developing cartridge according to claim 1, wherein the drum cam is configured to contact the apparatus body in the state where the drum cartridge is attached to the apparatus body, the drum cam being configured to press the first separation member in a direction away from the photosensitive drum upon receipt of a driving force from the apparatus body.

7. The developing cartridge according to claim 6, wherein the drum cam is configured to be pivotally moved relative to the photosensitive drum about a second axis extending in the first direction upon receipt of the driving force from the apparatus body to press the first separation member in the direction away from the photosensitive drum.

8. The developing cartridge according to claim 1, wherein the first separation member is in contact with the developing roller.

9. The developing cartridge according to claim 8, wherein the developing roller comprises a developing roller shaft extending in the first direction, and wherein the first separation member is pivotally movable about the developing roller shaft.

10. The developing cartridge according to claim 9, wherein the developing roller shaft is electrically conductive, and wherein the first separation member is made from electrically conductive resin.

11. The developing cartridge according to claim 9, wherein the first separation member has a shaft hole in which the developing roller shaft is rotatably inserted.

12. The developing cartridge according to claim 1, further comprising a storage medium having an electrical contact surface, the electrical contact surface being positioned at the first outer surface of the casing.

13. The developing cartridge according to claim 12, wherein the electrical contact surface is movable relative to the casing.

14. The developing cartridge according to claim 1, wherein the developing roller comprises a developing roller shaft extending in the first direction, and wherein the first separation member is pivotally movable about the developing roller shaft.

* * * * *